US008316932B2

(12) United States Patent
Kriesels

(10) Patent No.: US 8,316,932 B2
(45) Date of Patent: Nov. 27, 2012

(54) WELLBORE SYSTEM

(75) Inventor: Petrus Cornelis Kriesels, GS Rijswijk (NL)

(73) Assignee: Shell Oil Company, Houston, TX (US)

( * ) Notice: Subject to any disclaimer, the term of this patent is extended or adjusted under 35 U.S.C. 154(b) by 253 days.

(21) Appl. No.: 12/747,090

(22) PCT Filed: Dec. 11, 2008

(86) PCT No.: PCT/EP2008/067288

§ 371 (c)(1),
(2), (4) Date: Jun. 9, 2010

(87) PCT Pub. No.: WO2009/074632

PCT Pub. Date: Jun. 18, 2009

(65) Prior Publication Data

US 2010/0263859 A1 Oct. 21, 2010

(30) Foreign Application Priority Data

Dec. 13, 2007 (EP) ..... 07123096

(51) Int. Cl.
*E21B 19/08* (2006.01)

(52) U.S. Cl. ..... 166/207; 166/242.2; 166/384; 405/150.1

(58) Field of Classification Search ..... 166/277, 166/384, 207, 242.2; 175/171, 78, 52; 405/184, 405/165, 146, 150.1
See application file for complete search history.

(56) References Cited

U.S. PATENT DOCUMENTS

| | | | | | |
|---|---|---|---|---|---|
| 4,077,610 | A * | 3/1978 | Masuda | 254/134.4 |
| 4,431,069 | A * | 2/1984 | Dickinson et al. | 175/61 |
| 4,501,337 | A * | 2/1985 | Dickinson et al. | 175/171 |
| 5,169,264 | A | 12/1992 | Kimura | 405/184 |
| 5,680,885 | A * | 10/1997 | Catallo | 138/98 |
| 5,803,666 | A * | 9/1998 | Keller | 405/146 |
| 5,816,345 | A * | 10/1998 | Keller | 175/53 |
| 5,853,049 | A * | 12/1998 | Keller | 166/380 |
| 5,993,114 | A * | 11/1999 | Jones | 405/150.1 |
| 6,109,828 | A * | 8/2000 | Keller | 405/146 |
| 7,281,422 | B2 * | 10/2007 | Keller | 73/152.41 |

(Continued)

FOREIGN PATENT DOCUMENTS

EP 0044706 1/1982

(Continued)

OTHER PUBLICATIONS

Dickinson et al., Written Opinion for PCT/EP2008/067288, Jul. 2009.*

*Primary Examiner* — Jennifer H Gay

(57) ABSTRACT

A wellbore system comprises a wellbore extending into an earth formation, the wellbore containing a body of fluid, and an expandable tubular element arranged in the wellbore, wherein a lower end portion of the wall of the tubular element is bent radially outward and in an axially reverse direction so as to define an expanded tubular section extending around a remaining tubular section of the tubular element. The expanded tubular section is axially extendable by downward movement of the remaining tubular section relative to the expanded tubular section. The body of fluid is located in the remaining tubular section, and a fluid conduit extends from the body of fluid to a location above the remaining tubular section, the fluid conduit being movable in upward direction relative to the remaining tubular section.

10 Claims, 6 Drawing Sheets

U.S. PATENT DOCUMENTS

| | | | | |
|---|---|---|---|---|
| 7,387,174 | B2 * | 6/2008 | Lurie | 175/57 |
| 7,946,349 | B2 * | 5/2011 | Kriesels | 166/384 |
| 7,946,359 | B2 * | 5/2011 | Jeffryes et al. | 175/57 |
| 8,056,641 | B2 * | 11/2011 | Kriesels et al. | 166/384 |
| 8,056,642 | B2 * | 11/2011 | Kriesels et al. | 166/384 |
| 8,141,647 | B2 * | 3/2012 | Kriesels et al. | 166/380 |
| 2006/0130922 | A1 * | 6/2006 | Kamiyama et al. | 138/98 |
| 2007/0017669 | A1 * | 1/2007 | Lurie | 166/177.4 |
| 2009/0211765 | A1 * | 8/2009 | Keller | 166/377 |
| 2009/0255689 | A1 * | 10/2009 | Kriesels et al. | 166/384 |
| 2009/0288842 | A1 * | 11/2009 | Kriesels | 166/384 |
| 2010/0089593 | A1 * | 4/2010 | Hou et al. | 166/384 |
| 2010/0200248 | A1 * | 8/2010 | Kriesels et al. | 166/384 |
| 2010/0243275 | A1 * | 9/2010 | Kriesels | 166/384 |
| 2010/0252333 | A1 * | 10/2010 | Blange et al. | 175/424 |
| 2010/0263859 | A1 * | 10/2010 | Kriesels | 166/207 |
| 2010/0263878 | A1 * | 10/2010 | Van Nieuwkoop | 166/384 |
| 2010/0270036 | A1 * | 10/2010 | Kriesels | 166/384 |
| 2010/0270037 | A1 * | 10/2010 | Kriesels et al. | 166/384 |
| 2010/0276157 | A1 * | 11/2010 | Kriesels | 166/381 |
| 2010/0276202 | A1 * | 11/2010 | Kriesels | 175/61 |
| 2010/0294487 | A1 * | 11/2010 | Kriesels | 166/207 |
| 2010/0294513 | A1 * | 11/2010 | Van Nieuwkoop | 166/384 |
| 2010/0331959 | A1 * | 12/2010 | Kriesels et al. | 623/1.15 |
| 2011/0266007 | A1 * | 11/2011 | Hou et al. | 166/384 |
| 2011/0278009 | A1 * | 11/2011 | Elliott et al. | 166/307 |
| 2012/0138314 | A1 * | 6/2012 | Kriesels | 166/384 |

FOREIGN PATENT DOCUMENTS

| | | | |
|---|---|---|---|
| WO | WO9516556 | | 6/1995 |
| WO | WO03036025 | | 5/2003 |
| WO | WO2005024178 | | 3/2005 |
| WO | WO 2008061969 | A1 * | 5/2008 |
| WO | WO 2009065890 | A1 * | 5/2009 |
| WO | WO 2009074632 | A2 * | 6/2009 |

* cited by examiner

WELLBORE SYSTEM

PRIORITY CLAIM

The present application claims priority to PCT Application EP2008/067288, filed 11 Dec. 2008, which in turn claims priority from European Application EP07123096.5, filed 13 Dec. 2007.

TECHNICAL FIELD OF THE INVENTION

The present invention relates to a wellbore system comprising a wellbore extending into an earth formation, the wellbore containing a body of fluid, whereby an expandable tubular element is arranged in the wellbore.

BACKGROUND OF THE INVENTION

The technology of radially expanding tubular elements in wellbores finds increasing application in the industry of oil and gas production from subterranean formations. Wellbores are generally provided with one or more casings or liners to provide stability to the wellbore wall, and/or to provide zonal isolation between different earth formation layers. The terms "casing" and "liner" refer to tubular elements for supporting and stabilising the wellbore wall, whereby it is generally understood that a casing extends from surface into the wellbore and that a liner extends from a certain depth further into the wellbore. However, in the present context, the terms "casing" and "liner" are used interchangeably and without such intended distinction.

In conventional wellbore construction, several casings are set at different depth intervals, and in a nested arrangement, whereby each subsequent casing is lowered through the previous casing and therefore has a smaller diameter than the previous casing. As a result, the cross-sectional wellbore size that is available for oil and gas production, decreases with depth. To alleviate this drawback, it has become general practice to radially expand one or more tubular elements at the desired depth in the wellbore, for example to form an expanded casing, expanded liner, or a clad against an existing casing or liner. Also, it has been proposed to radially expand each subsequent casing to substantially the same diameter as the previous casing to form a monobore wellbore. It is thus achieved that the available diameter of the wellbore remains substantially constant along (a portion of) its depth as opposed to the conventional nested arrangement.

EP 1438483 B1 discloses a system for expanding a tubular element in a wellbore whereby the tubular element, in unexpanded state, is initially attached to a drill string during drilling of a new wellbore section.

To expand such wellbore tubular element, generally a conical expander is used with a largest outer diameter substantially equal to the required tubular diameter after expansion. The expander is pumped, pushed or pulled through the tubular element. Such method can lead to high friction forces between the expander and the tubular element. Also, there is a risk that the expander becomes stuck in the tubular element.

EP 0044706 A2 discloses a flexible tube of woven material or cloth that is expanded in a wellbore by eversion to separate drilling fluid pumped into the wellbore from slurry cuttings flowing towards the surface.

However there is a need for an improved wellbore system whereby a tubular element is radially expanded in a wellbore.

SUMMARY OF THE INVENTION

In accordance with the invention there is provided a wellbore system comprising a) a wellbore extending into an earth formation, the wellbore containing a body of fluid;

b) an expandable tubular element arranged in the wellbore, whereby a lower end portion of the wall of the tubular element is bent radially outward and in axially reverse direction so as to define an expanded tubular section extending around a remaining tubular section of the tubular element, the expanded tubular section being axially extendable by downward movement of the remaining tubular section relative to the expanded tubular section, wherein the body of fluid is located in the remaining tubular section;

c) a fluid conduit extending from the body of fluid to a location above the remaining tubular section, the fluid conduit being movable in upward direction relative to the remaining tubular section.

By moving the remaining tubular section downward relative to the expanded tubular section, the tubular element is effectively turned inside out whereby the tubular element is progressively expanded without the need for an expander that is pushed, pulled or pumped through the tubular element. The expanded tubular section can form a casing or liner in the wellbore.

Furthermore, by moving the fluid conduit upwardly relative to the remaining tubular section it is achieved that the remaining tubular section can be extended at its upper end while also fluid is discharged from the body of fluid, or pumped into the body of fluid, via the fluid conduit.

Suitably the fluid conduit is arranged to move in upward direction relative to the remaining tubular section in correspondence with said downward movement of the remaining tubular section relative to the expanded tubular section.

It is preferred that the remaining tubular section is extended at its upper end with an extension member having a transverse opening for passage of the fluid conduit therethrough from outside the extension member to inside the extension member. In this manner it is achieved that the extension member can be moved to above the upper end of the remaining tubular section, whereby the fluid conduit passes through the transverse opening, without having to remove the fluid conduit.

In an advantageous embodiment, a drill string extends through the remaining tubular section, the drill string being capable of passing through the transverse opening of the extension member from outside the extension member to inside the extension member. Thus, the remaining tubular section can be extended at the upper end without having to remove the drill string from the wellbore.

Suitably the remaining tubular section and the drill string are arranged for simultaneous lowering through the wellbore.

The fluid conduit is suitably sealed relative to the remaining tubular section, thus allowing fluid in the wellbore to be pressurised.

It is preferred that the wall of the tubular element includes a material that is plastically deformed in the bending zone, so that the expanded tubular section retains an expanded shape as a result of said plastic deformation. In this manner it is achieved that the expanded tubular section remains in expanded form due to plastic deformation, i.e. permanent deformation, of the wall. Thus, there is no need for an external force or pressure to maintain the expanded form. If, for example, the expanded tubular section has been expanded against the wellbore wall as a result of said bending of the wall, no external radial force or pressure needs to be exerted to the expanded tubular section to keep it against the wellbore wall. Suitably the wall of the tubular element is made of a metal such as steel or any other ductile metal capable of being plastically deformed by eversion of the tubular element. The expanded tubular section then has adequate collapse resistance, for example in the order of 100-150 bars.

Suitably the bending zone is induced to move in axial direction relative to the remaining tubular section by inducing the remaining tubular section to move in axial direction relative to the expanded tubular section. For example, the expanded tubular section is held stationary while the remaining tubular section is moved in axial direction through the expanded tubular section to induce said bending of the wall.

In order to induce said movement of the remaining tubular section, preferably the remaining tubular section is subjected to an axially compressive force acting to induce said movement. The axially compressive force preferably at least partly results from the weight of the remaining tubular section. If necessary the weight can be supplemented by an external, downward, force applied to the remaining tubular section to induce said movement. As the length, and hence the weight, of the remaining tubular section increases, an upward force may need to be applied to the remaining tubular section to prevent uncontrolled bending or buckling in the bending zone.

If the bending zone is located at a lower end of the tubular element, whereby the remaining tubular section is axially shortened at a lower end thereof due to said movement of the bending zone, it is preferred that the remaining tubular section is axially extended at an upper end thereof in correspondence with said axial shortening at the lower end thereof. The remaining tubular section gradually shortens at its lower end due to continued reverse bending of the wall. Therefore, by extending the remaining tubular section at its upper end to compensate for shortening at its lower end, the process of reverse bending the wall can be continued until a desired length of the expanded tubular section is reached. The remaining tubular section can be extended at its upper end, for example, by connecting a tubular portion to the upper end in any suitable manner such as by welding. Alternatively, the remaining tubular section can be provided as a coiled tubing which is unreeled from a reel and subsequently inserted into the wellbore.

Advantageously the wellbore is being drilled with a drill string extending through the unexpanded tubular section. In such application the unexpanded tubular section and the drill string preferably are lowered simultaneously through the wellbore during drilling with the drill string.

Optionally the bending zone can be heated to promote bending of the tubular wall.

BRIEF DESCRIPTION OF THE DRAWINGS

The invention will be described hereinafter in more detail and by way of example, with reference to the accompanying drawings in which.

In the drawings and the description, like reference numerals relate to like components. Several features are shown in longitudinal section, some of which being partly broken away for clarity.

DETAILED DESCRIPTION OF THE PREFERRED EMBODIMENTS

Figure 1:
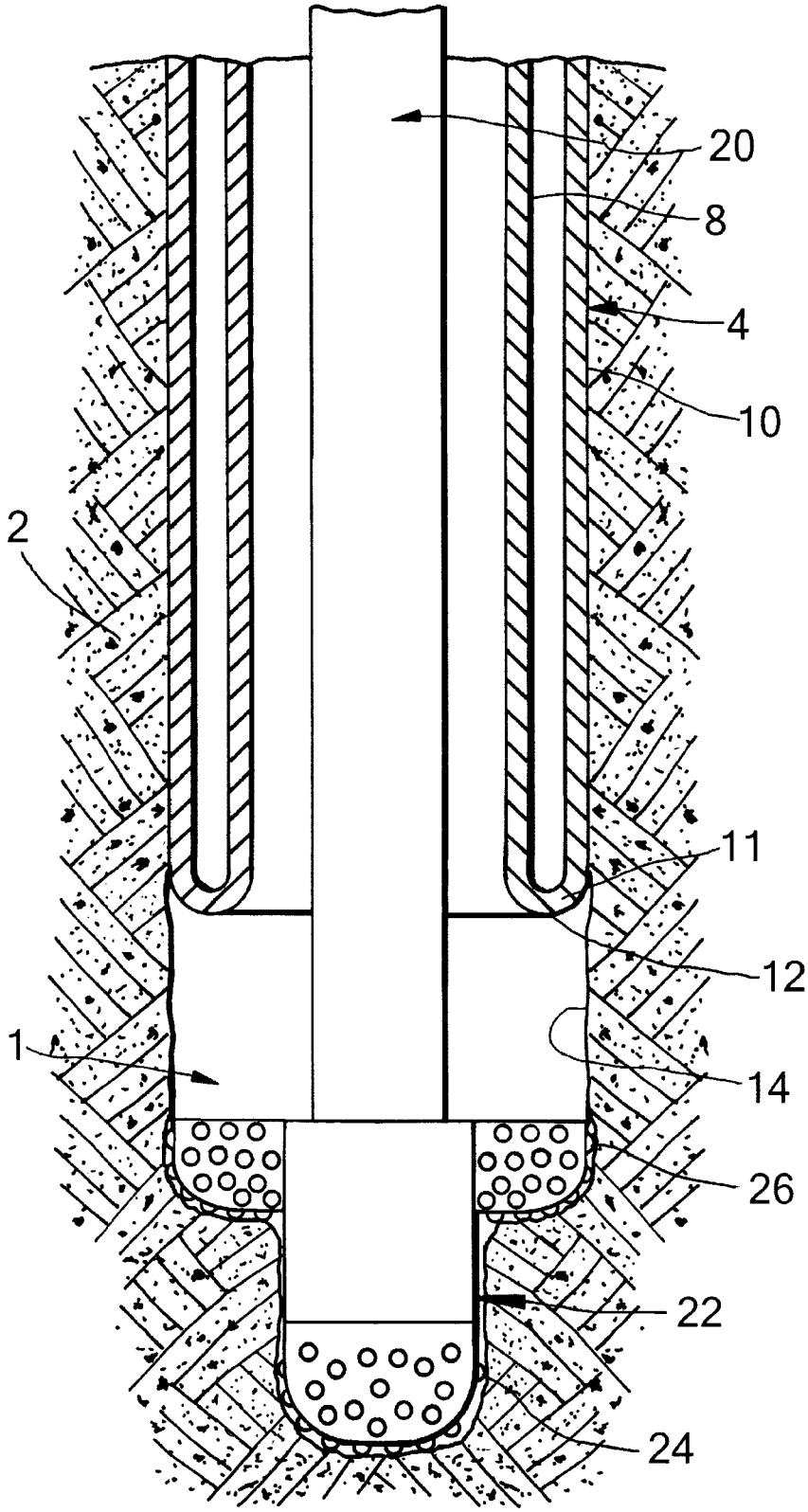
FIG. 1 schematically shows a lower portion of a first embodiment of a wellbore system in accordance with the invention.

Referring to FIG. 1 there is shown a wellbore system including a wellbore 1 extending into an earth formation 2, and a tubular element in the form of liner 4 extending from surface downwardly into the wellbore 1. The liner 4 has been partially radially expanded by eversion of the wall of the liner whereby a radially expanded tubular section 10 of the liner 4 has been formed, which has an outer diameter substantially equal to the wellbore diameter. A remaining tubular section of the liner 4, in the form of unexpanded liner section 8, extends concentrically within the expanded tubular section 10.

The wall of the liner 4 is, due to eversion at its lower end, bent radially outward and in axially reverse (i.e. upward) direction so as to form a U-shaped lower section 11 of the liner interconnecting the unexpanded liner section 8 and the expanded liner section 10. The U-shaped lower section 11 of the liner 4 defines a bending zone 12 of the liner.

The expanded liner section 10 is axially fixed to the wellbore wall 14 by virtue of frictional forces between the expanded liner section 10 and the wellbore wall 14 resulting from the expansion process. Alternatively, or additionally, the expanded liner section 10 can be anchored to the wellbore wall by any suitable anchoring means (not shown).

A drill string 20 extends from surface through the unexpanded liner section 8 to the bottom of the wellbore 1. The drill string 20 is at its lower end provided with a drill bit 22 comprising a pilot bit 24 with gauge diameter slightly smaller than the internal diameter of the unexpanded liner section 8, and a reamer section 26 with gauge diameter adapted to drill the wellbore 1 to its nominal diameter. The reamer section 26 is radially retractable to an outer diameter allowing it to pass through unexpanded liner section 8, so that the drill string 20 can be retrieved through the unexpanded liner section 8 to surface.

Figure 2:
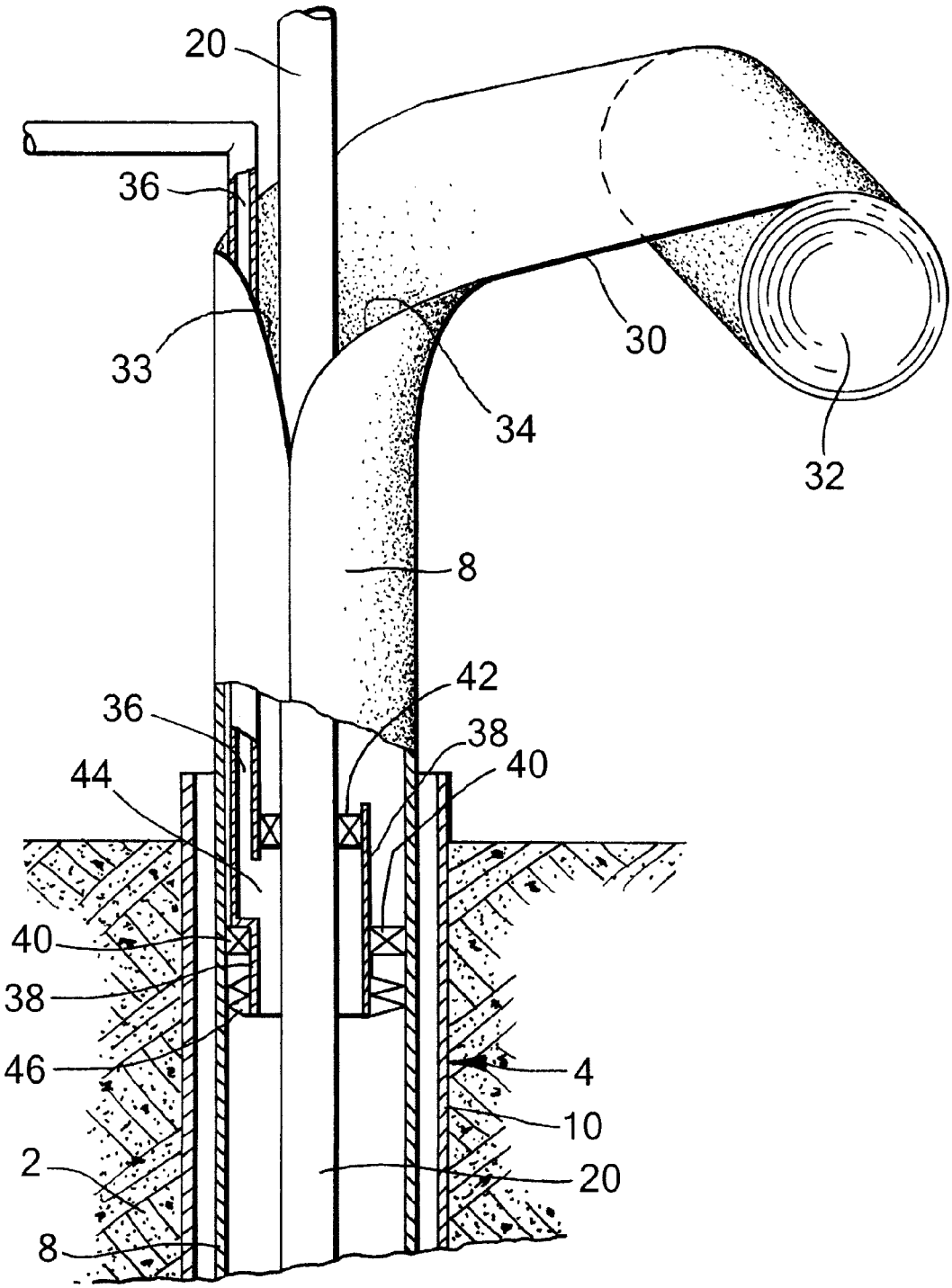
FIG. 2 schematically shows an upper portion of the first embodiment.

Referring further to FIG. 2 there is shown an upper portion of the system of FIG. 1. The unexpanded liner section 8 is at its upper end formed from a metal sheet 30 wound on a reel 32. The metal sheet 30 has opposite edges 33, 34. After unreeling from the reel 32, the metal sheet 30 is bent into a tubular shape whereafter the edges 33, 34 are interconnected by welding to form the unexpanded tubular section 8.

A fluid conduit in the form of outlet conduit 36 extends from the interior of the unexpanded tubular section 8, to above the upper end of the unexpanded tubular section 8. The outlet conduit 36 is at its lower end connected to, or integrally formed with, a tube 38 located in the unexpanded tubular section 8. A first annular seal 40 seals the tube 38 relative to the unexpanded liner section 8, and a second annular seal 42 seals the tube 38 relative to the drill string 20. The outlet conduit 36 is in fluid communication with the interior space of the tube 38 via an opening 44 provided in the wall of the tube 38. Furthermore the tube 38 is provided with gripper means 46 allowing upward sliding, and preventing downward sliding, of the tube 38 relative to the unexpanded liner section 8. The first annular seal 40 allows upward sliding of the tube 38 relative to the unexpanded liner section 8.

Figure 3:
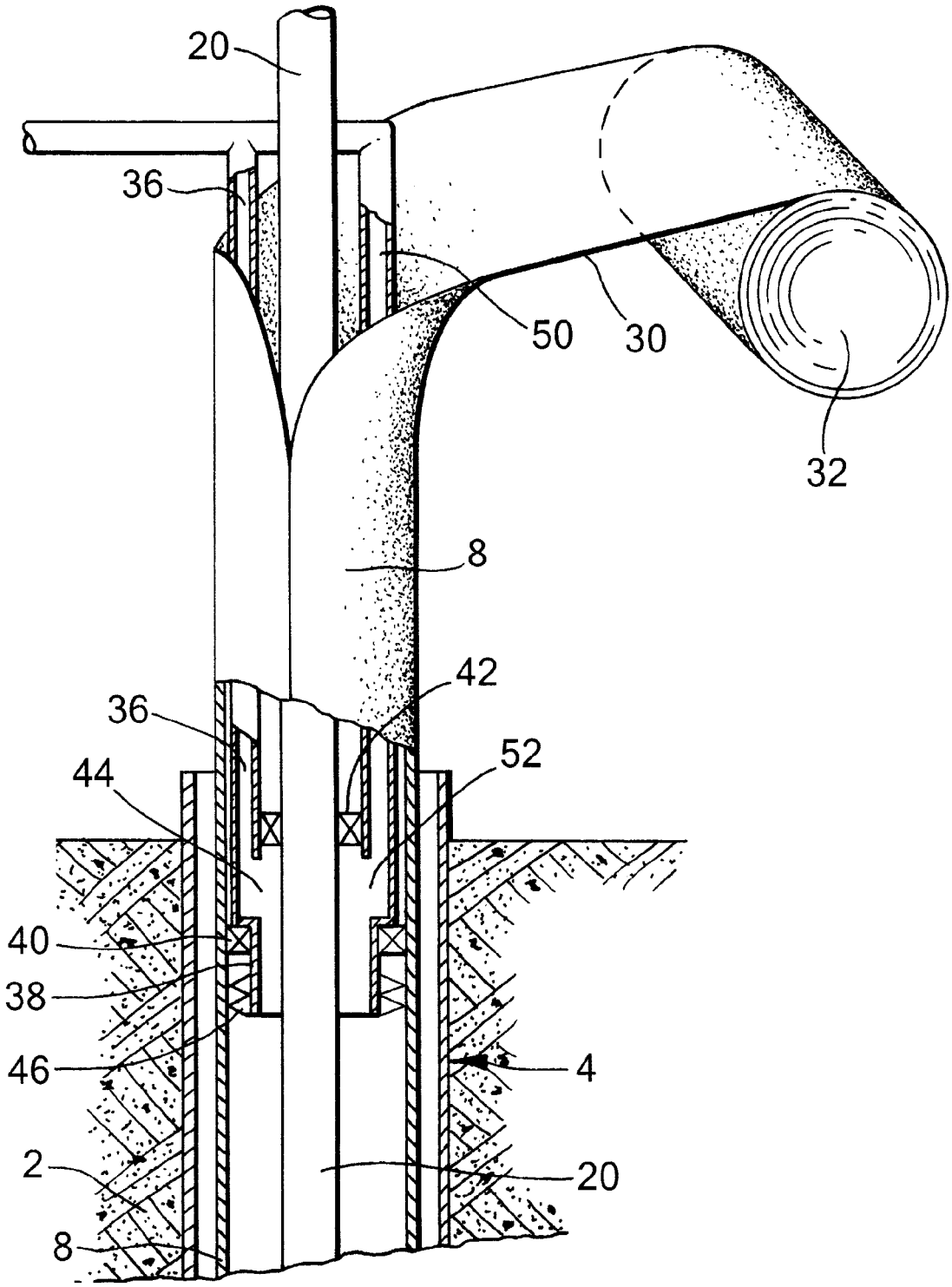
FIG. 3 schematically shows an upper portion of a second embodiment of a wellbore system according to the invention.

In FIG. 3 is shown the upper portion of the second embodiment, which is substantially similar to the first embodiment, except that an additional outlet conduit 50 extends from the interior of the unexpanded liner section 8, to above the upper end of the unexpanded liner section 8. The additional outlet conduit 50 is at its lower end connected to, or integrally formed with, the tube 38, and the is in fluid communication with the interior space of the tube 38 via an opening 52 provided in the wall of the tube 38. If desired, more than two such outlet conduits can be applied in similar manner.

Figure 4:
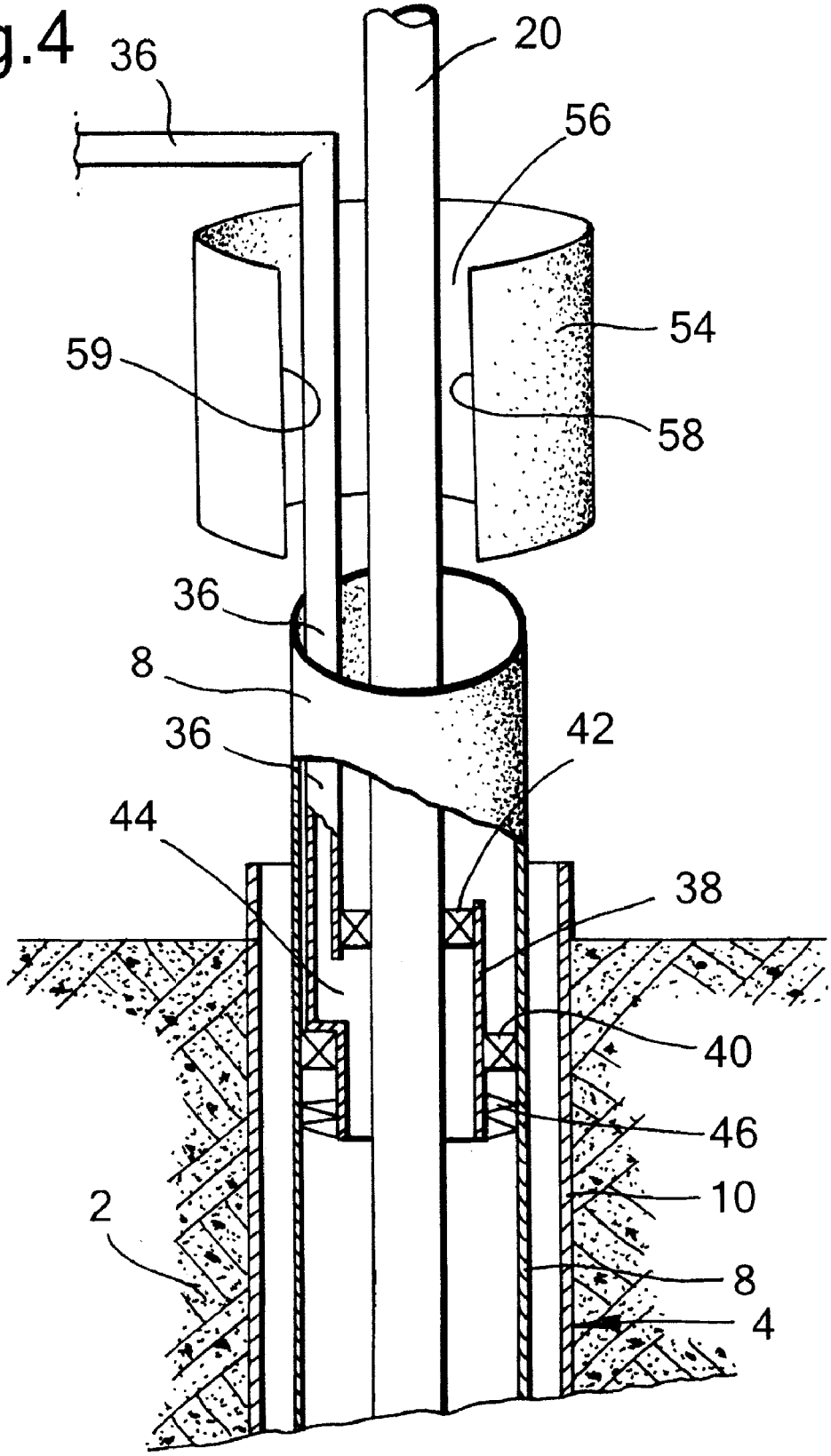
FIG. 4 schematically shows an upper portion of a third embodiment of a wellbore system according to the invention during an initial stage of operation.

In FIG. 4 is shown the upper portion of the third embodiment that is substantially similar to the first embodiment except that, instead of the reeled metal sheet, an extension member 54 is arranged at the upper end of the unexpanded liner section 8. The extension member 54 is adapted to extend the unexpanded liner section 8 at its upper end, and has a transverse opening 56 through which the outlet conduit 36 and the drill string 20 can pass, from outside the extension member 54 to inside the extension member. The transverse opening 56 is defined between opposite longitudinal edges 58, 59 of the extension member 54, which extend in axial direction. The extension member 54 can be formed, for example, from a piece of pipe cut in longitudinal direction to form the edges 58, 59, the piece of pipe having the same diameter and wall thickness as the unexpanded liner section 8.

Figure 5:
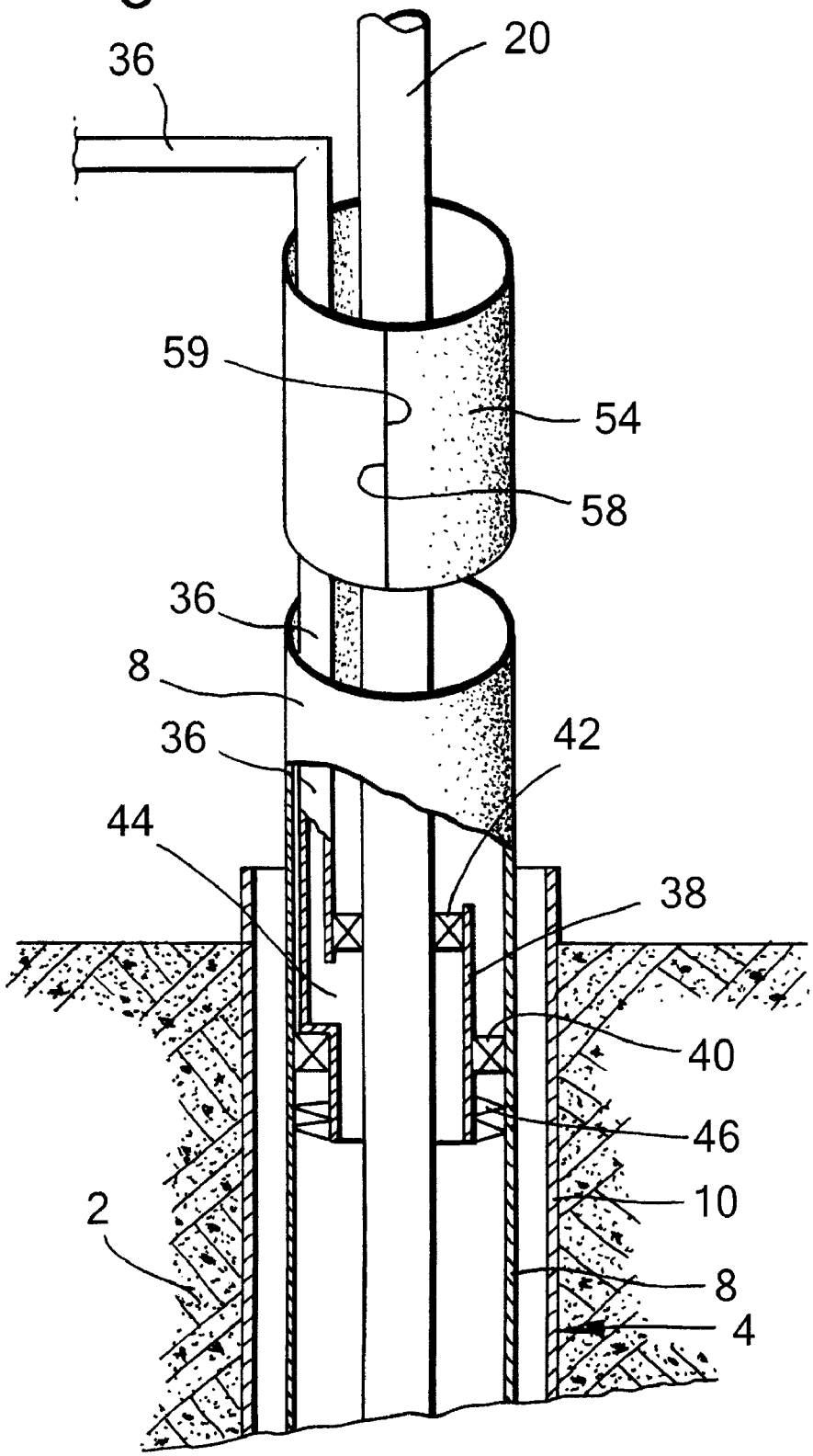
FIG. 5 schematically shows the upper portion of the third embodiment during a further stage of operation.

In FIG. 5 is shown the upper portion of the third embodiment, after the longitudinal edges 58, 59 of the extension member 54 have been welded together.

Figure 6:
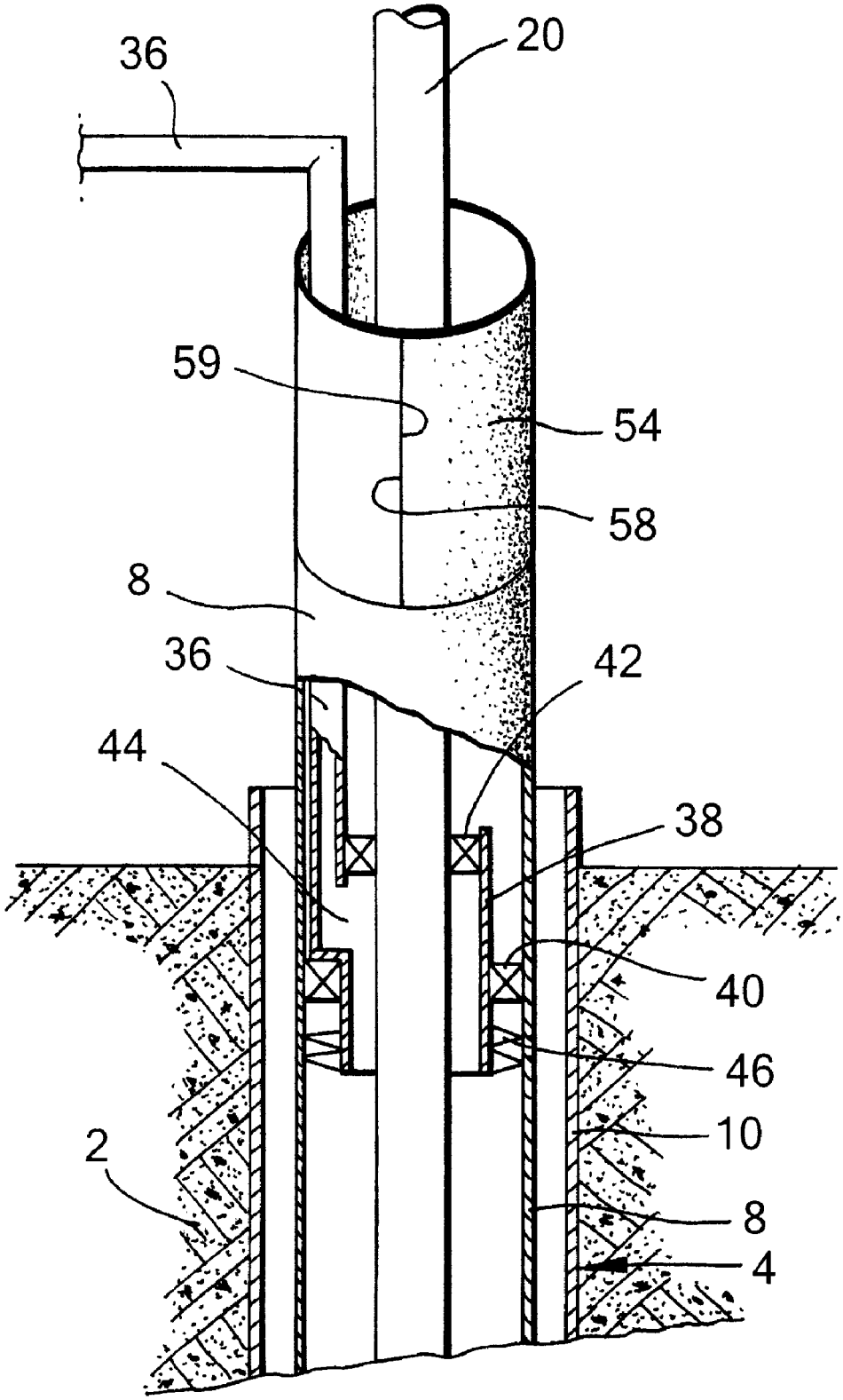
FIG. 6 schematically shows the upper portion of the third embodiment during an even further stage of operation.

In FIG. 6 is shown the upper portion of the third embodiment, after the longitudinal edges 58, 59 have been welded together and the extension member 54 has been connected to the upper end of the unexpanded liner section 8 by welding.

During normal operation of the first embodiment (FIGS. 1 and 2), a lower end portion of the liner 4 is initially everted, that is, the lower portion is bent radially outward and in axially reverse direction. The U-shaped lower section 11 and the expanded liner section 10 are thereby initiated. Subsequently, the short length of expanded liner section 10 that has been formed is anchored to the wellbore wall by any suitable anchoring means. Depending on the geometry and/or material properties of the liner 4, the expanded liner section 10 alternatively can become anchored to the wellbore wall automatically due to friction between the expanded liner section 10 and the wellbore wall 14.

A downward force is then applied to the unexpanded liner section 8 so as to move the unexpanded liner section 8 gradually downward. As a result, the unexpanded liner section 8 becomes progressively everted thereby progressively transforming the unexpanded liner section 8 into the expanded liner section 10. The bending zone 12 moves in downward direction during the eversion process, at approximately half the speed of movement of the unexpanded liner section 8.

If desired, the diameter and/or wall thickness of the liner 4 can be selected such that the expanded liner section 10 is pressed against the wellbore wall 14 as a result of the expansion process so as to seal against the wellbore wall 14 and/or to stabilize the wellbore wall.

Since the length, and hence the weight, of the unexpanded liner section 8 gradually increases, the magnitude of the downward force can be gradually lowered in correspondence with the increasing weight of liner section 8. As the weight increases, the downward force eventually may need to be replaced by an upward force to prevent buckling of liner section 8.

Simultaneously with downward movement of the unexpanded liner section 8 into the wellbore, the drill string 20 is operated to rotate the drill bit 22 and thereby deepen the wellbore 1 by further drilling. The drill string 20 thereby gradually moves downward into the wellbore 1. The unexpanded liner section 8 is moved downward in a controlled manner and at substantially the same speed as the drill string 20, so that it is ensured that the bending zone 12 remains at a short distance above the drill bit 22. Controlled lowering of the unexpanded liner section 8 can be achieved, for example, by controlling the downward force, or upward force, referred to hereinbefore. Suitably, the unexpanded liner section 8 is supported by the drill string 20, for example by means of a bearing device (not shown) connected to the drill string, which supports the U-shaped lower section 11. In that case the upward force is suitably applied to the drill string 20, and then transmitted to the unexpanded liner section 8 through the bearing device. Furthermore, the weight of the unexpanded liner section 8 then can be transferred to the drill string and utilised to provide a thrust force to the drill bit 22.

During operation of the drill string 20, drilling fluid is pumped from surface via the drill string 20 and drill bit 22 into the wellbore 1 so that the wellbore is filled with a body of fluid extending into the unexpanded liner section 8 and the tube 38. Drilling fluid containing drill cuttings is discharged from the wellbore 1 via outlet conduit 36. Alternatively, drilling fluid may be circulated in reverse circulation mode whereby the drilling fluid is pumped into the wellbore via the outlet conduit 36 and discharged from the wellbore via the drill string 20.

The unexpanded liner section 8 is at its upper end extended in correspondence with its downward movement, by unreeling the metal sheet 30 from the reel 32, then bending the metal sheet 30 around the outlet conduit 36 and the drill string 20, and welding the edges 33, 34 together to form the sheet 30 into a tubular shape.

Furthermore, simultaneously with downward movement of the unexpanded liner section 8 and corresponding extension at its upper end, the tube 38 is induced to slide upwards relative to the unexpanded liner section 8 such that the upper end of outlet conduit 36 remains above unexpanded liner section 8. This can be done, for example, by keeping the assembly of tube 38 and outlet conduit 36 stationary while the unexpanded liner section moves downward. The gripper means 46 prevents inadvertent downward movement of the assembly relative to liner section 8.

Normal operation of the second embodiment (FIG. 3) is substantially similar to normal operation of the first embodiment whereby in addition to the outlet conduit 36, the additional conduit 50 is used to discharge fluid from the wellbore to increase the flow area of the discharged fluid.

Normal operation of the third embodiment (FIGS. 4-6) is substantially similar to normal operation of the first embodiment, except that the extension member 54 is used to extend unexpanded liner section 8 at its upper end instead of the reeled metal sheet. Thereto, the extension member 54 is moved in transverse direction to above the top of unexpanded liner section 8 so that the drill string 20 and the outlet conduit 36 pass through transverse opening 56 (FIG. 4). In a further stage, the extension member 54 is bent around the drill string and outlet conduit so that the edges 58, 59 are in abutment, whereafter the edges 58, 59 are welded together (FIG. 5). The extension member 56 is then lowered onto the top of unexpanded liner section 8 and connected thereto by welding (FIG. 6) so as to form an integral part of the unexpanded liner section 8. As drilling proceeds similar extension members are added to the unexpanded liner section 8 in corresponding manner.

When it is required to retrieve the drill string 20 to surface, for example when the drill bit 26 is to be replaced or when drilling of the wellbore 1 is complete, the reamer section 26 brought to its radially retracted mode. Subsequently the drill string 20 is retrieved through the unexpanded liner section 8 to surface.

With the wellbore system of the invention, it is achieved that the wellbore is progressively lined with the everted liner directly above the drill bit, during the drilling process. As a result, there is only a relatively short open-hole section of the wellbore during the drilling process at all times. The advantages of such short open-hole section will be most pronounced during drilling into a hydrocarbon fluid containing layer of the earth formation. In view thereof, for many applications it will be sufficient if the process of liner eversion during drilling is applied only during drilling into the hydrocarbon fluid reservoir, while other sections of the wellbore are lined or cased in conventional manner. Alternatively, the process of liner eversion during drilling may be commenced at surface or at a selected downhole location, depending on circumstances.

In view of the short open-hole section during drilling, there is a significantly reduced risk that the wellbore fluid pressure gradient exceeds the fracture gradient of the rock formation, or that the wellbore fluid pressure gradient drops below the pore pressure gradient of the rock formation. Therefore, considerably longer intervals can be drilled at a single nominal diameter than in a conventional drilling practice whereby casings of stepwise decreasing diameter must be set at selected intervals.

Also, if the wellbore is drilled through a shale layer, such short open-hole section eliminates possible problems due to a heaving tendency of the shale.

Furthermore, the feature that the outlet conduit is axially movable relative to the unexpanded liner section allows the unexpanded liner section to be extended at the top without hampering circulation of drilling fluid in the wellbore via the unexpanded liner section and the outlet conduit.

After the wellbore has been drilled to the desired depth and the drill string has been removed from the wellbore, the length of unexpanded liner section that is still present in the wellbore can be left in the wellbore or it can be cut-off from the expanded liner section and retrieved to surface.

In case the length of unexpanded liner section is left in the wellbore, there are several options for completing the wellbore. These are, for example, as outlined below.

A) A fluid, for example brine, is pumped into the annulus between the unexpanded and expanded liner sections so as to pressurise the annulus and increase the collapse resistance of the expanded liner section. Optionally one or more holes are provided in the U-shaped lower section to allow the pumped fluid to be circulated.

B) A heavy fluid is pumped into the annulus so as to support the expanded liner section and increase its collapse resistance.

C) Cement is pumped into the annulus in order to create, after hardening of the cement, a solid body between the unexpanded liner section and the expanded liner section, whereby the cement may expand upon hardening.

D) The unexpanded liner section is radially expanded (i.e. clad) against the expanded liner section, for example by pumping, pushing or pulling an expander through the unexpanded liner section.

In the above examples, expansion of the liner is started at surface or at a downhole location. In case of an offshore wellbore whereby an offshore platform is positioned above the wellbore, at the water surface, it can be advantageous to start the expansion process at the offshore platform. In such process, the bending zone moves from the offshore platform to the seabed and from there further into the wellbore. Thus, the resulting expanded tubular element not only forms a liner in the wellbore, but also a riser extending from the offshore platform to the seabed. The need for a separate riser from is thereby obviated.

Furthermore, conduits such as electric wires or optical fibres for communication with downhole equipment can be extended in the annulus between the expanded and unexpanded sections. Such conduits can be attached to the outer surface of the tubular element before expansion thereof. Also, the expanded and unexpanded liner sections can be used as electricity conductors to transfer data and/or power downhole.

Since any length of unexpanded liner section that is still present in the wellbore after completion of the eversion process, will be subjected to less stringent loading conditions than the expanded liner section, such length of unexpanded liner section may have a smaller wall thickness, or may be of lower quality or steel grade, than the expanded liner section. For example, it may be made of pipe having a relatively low yield strength or relatively low collapse rating.

Instead of leaving a length of unexpanded liner section in the wellbore after the expansion process, the entire liner can be expanded with the method described above so that no unexpanded liner section remains in the wellbore. In such case, an elongate member, for example a pipe string, can be used to exert the necessary downward force to the unexpanded liner section during the last phase of the expansion process.

In order to reduce friction forces between the unexpanded and expanded liner sections during the expansion process, suitably a friction reducing layer, such as a Teflon layer, is applied between the unexpanded and expanded liner sections. For example, a friction reducing coating can be applied to the outer surface of the tubular element before expansion. Such layer of friction reducing material furthermore reduces the annular clearance between the unexpanded and expanded sections, thus resulting in a reduced buckling tendency of the unexpanded section. Instead of, or in addition to, such friction reducing layer, centralizing pads and/or rollers can be applied between the unexpanded and expanded sections to reduce the friction forces and the annular clearance there-between.

Instead of expanding the expanded liner section against the wellbore wall (as described), the expanded liner section can be expanded against the inner surface of another tubular element already present in the wellbore.

The invention claimed is:

1. A wellbore system comprising a) a wellbore extending into an earth formation, the wellbore containing a body of fluid;

b) an expandable tubular element arranged in the wellbore, whereby a lower end portion of the wall of the tubular element is bent radially outward and in an axially reverse direction so as to define an expanded tubular section extending around a remaining tubular section of the tubular element, the expanded tubular section being axially extendable by downward movement of the remaining tubular section relative to the expanded tubular section, wherein the body of fluid is located in the remaining tubular section;

c) a fluid conduit extending from the body of fluid to a location above the remaining tubular section such that drilling fluid containing drill cuttings may be discharged from the wellbore via said fluid conduit, the fluid conduit being movable in upward direction relative to the remaining tubular section.

2. The wellbore system of claim 1, wherein the fluid conduit is arranged to move in an upward direction relative to the remaining tubular section in correspondence with said downward movement of the remaining tubular section relative to the expanded tubular section.

3. The wellbore system of claim 1, further comprising an extension member adapted to extend the remaining tubular section at the upper end thereof, said extension member having a transverse opening for passage of the fluid conduit therethrough from outside the extension member to inside the extension member.

4. The wellbore system of claim 3, wherein a drill string extends through the remaining tubular section, the drill string being capable of passing through the transverse opening of the extension member from outside the extension member to inside the extension member.

5. The wellbore system of claim 4, wherein the remaining tubular section and the drill string are arranged for simultaneous lowering through the wellbore.

6. The wellbore system of claim 1 wherein the fluid conduit is sealed relative to the remaining tubular section.

7. The wellbore system of claim 1 wherein the fluid conduit is provided with gripper means arranged to prevent downward movement of the fluid conduit relative to the remaining tubular section.

8. The wellbore system of claim 1 wherein the wall of the tubular element includes a material susceptible of plastic deformation during the bending process so that the expanded tubular section retains an expanded shape as a result of said plastic deformation.

9. The wellbore system of claim 1 wherein the remaining tubular section is subjected to an axially compressive force inducing said downward movement of the remaining tubular section.

10. The wellbore system of claim 9, wherein said axially compressive force is at least partly due to the weight of the remaining tubular section.

* * * * *